US010161617B2

(12) United States Patent
Kanayama et al.

(10) Patent No.: US 10,161,617 B2
(45) Date of Patent: Dec. 25, 2018

(54) LIGHTING APPARATUS, AUTOMOBILE, AND PROJECTION LENS

(71) Applicant: Panasonic Intellectual Property Management Co., Ltd., Osaka (JP)

(72) Inventors: Yoshihiko Kanayama, Hyogo (JP); Naoki Tomoda, Osaka (JP); Hideaki Hyuga, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 65 days.

(21) Appl. No.: 15/390,872

(22) Filed: Dec. 27, 2016

(65) Prior Publication Data

US 2017/0184268 A1 Jun. 29, 2017

(30) Foreign Application Priority Data

Dec. 28, 2015 (JP) ..... 2015-257544

(51) Int. Cl.
*F21S 8/10* (2006.01)
*F21V 29/503* (2015.01)
(Continued)

(52) U.S. Cl.
CPC ..... *F21V 29/503* (2015.01); *F21S 41/147* (2018.01); *F21S 41/19* (2018.01); *F21S 41/255* (2018.01); *F21S 41/275* (2018.01); *F21S 41/295* (2018.01); *F21S 41/321* (2018.01); *F21S 41/333* (2018.01); *F21V 29/763* (2015.01); *F21V 29/85* (2015.01); *F21S 41/43* (2018.01); *F21S 45/47* (2018.01)

(58) Field of Classification Search
CPC ..... F21S 41/25; F21S 41/275; F21S 48/1283; F21S 41/255; F21S 41/295; F21S 41/321
See application file for complete search history.

(56) References Cited

U.S. PATENT DOCUMENTS

2007/0230204 A1 10/2007 Tatsukawa
2014/0334177 A1* 11/2014 de Lamberterie .. F21S 48/1283 362/522

(Continued)

FOREIGN PATENT DOCUMENTS

JP 2007-265864 10/2007
JP 2013-093105 5/2013

(Continued)

*Primary Examiner* — Karabi Guharay
(74) *Attorney, Agent, or Firm* — Renner, Otto, Boisselle & Sklar, LLP

(57) ABSTRACT

A lighting apparatus includes: a projection lens; a light source behind the projection lens; a reflector that reflects light from the light source toward the projection lens; and a shield that blocks a portion of the light reflected by the reflector to form a cutoff line in a distribution pattern of the light. A textured section demarcated by unit regions is formed on a surface of the projection lens, and when a region in a center of the projection lens is defined as a central region, and regions left and right of the central region are defined as left and right regions, respectively, in a front view, a proportion of the unit regions in the central region is greater than a proportion of the unit regions in each of the left region and the right region.

11 Claims, 7 Drawing Sheets

(51) Int. Cl.

| | |
|---|---|
| ***F21V 29/76*** | (2015.01) |
| ***F21V 29/85*** | (2015.01) |
| ***F21S 41/19*** | (2018.01) |
| ***F21S 41/147*** | (2018.01) |
| ***F21S 41/29*** | (2018.01) |
| ***F21S 41/255*** | (2018.01) |
| ***F21S 41/275*** | (2018.01) |
| ***F21S 41/32*** | (2018.01) |
| ***F21S 41/33*** | (2018.01) |
| *F21S 41/43* | (2018.01) |
| *F21S 45/47* | (2018.01) |

(56) References Cited

U.S. PATENT DOCUMENTS

| | | | | |
|---|---|---|---|---|
| 2015/0241008 | A1 | 8/2015 | Matsumoto et al. | |
| 2016/0238207 | A1* | 8/2016 | Hsieh ..... | F21S 41/143 |

FOREIGN PATENT DOCUMENTS

| | | |
|---|---|---|
| JP | 2014-157733 | 8/2014 |
| JP | 2014-175198 | 9/2014 |
| JP | 2014-235836 | 12/2014 |
| JP | 2015-035337 | 2/2015 |
| JP | 2015-173096 | 10/2015 |

* cited by examiner

LIGHTING APPARATUS, AUTOMOBILE, AND PROJECTION LENS

CROSS REFERENCE TO RELATED APPLICATION

This application claims the benefit of priority of Japanese Patent Application Number 2015-257544 filed on Dec. 28, 2015, the entire content of which is hereby incorporated by reference.

BACKGROUND

1. Technical Field

The present disclosure relates to a lighting apparatus, an automobile including the lighting apparatus, and a projection lens.

2. Description of the Related Art

Vehicles such as automobiles are equipped with lighting apparatuses as headlights (headlamps) in the front. Such lighting apparatuses include a projection lens, a light source behind the projection lens, a reflector that reflects light from the light source toward the projection lens, and a shield that blocks a portion of light coming directly from the light source to form a cutoff line in a distribution pattern of the light.

One conventionally known lighting apparatus of this type is a vehicle lamp capable of inhibiting an uneven distribution of light and reducing contrast between light and dark regions resulting from the cutoff line by forming a textured section on the projection lens (see Japanese Unexamined Patent Application Publication No. 2015-35337).

SUMMARY

Light projected by an automobile headlight preferably has a distribution pattern that allows the driver of the automobile to easily spot pedestrians.

However, the vehicle lamp disclosed in Japanese Unexamined Patent Application Publication No. 2015-35337 cannot ensure sufficient illuminance in the left and right regions of the field of view. As a result, the driver cannot easily spot pedestrians.

The present disclosure has been conceived to overcome the above problem and has an object to provide a lighting apparatus, automobile, and projection lens capable of maintaining an appropriate amount of light scattering and ensuring sufficient illuminance in the left and right regions of the field of view in addition to inhibiting glare by ensuring that light is scattered around the top and bottom of the cutoff line in the center region of the field of view.

In order to achieve the above object, according to one aspect of the present disclosure, a lighting apparatus includes: a projection lens; a light source behind the projection lens; a reflector that reflects light from the light source toward the projection lens; and a shield that blocks a portion of the light reflected by the reflector to form a cutoff line in a distribution pattern of the light. A textured section demarcated by a plurality of unit regions is formed on a surface of the projection lens. When a region in a center of the projection lens is defined as a central region, a region left of the central region is defined as a left region, and a region right of the central region is defined as a right region, in a front view, a proportion of the plurality of unit regions in the central region is greater than a proportion of the plurality of unit regions in each of the left region and the right region.

Moreover, according to one aspect of the present disclosure, an automobile includes the above lighting apparatus; and a vehicle body on which the lighting apparatus is installed as a headlamp.

Moreover, according to one aspect of the present disclosure, a projection lens includes a light-transmissive lens substrate. A textured section demarcated by a plurality of unit regions is formed on a surface of the substrate. When a region in a center of the projection lens is defined as a central region, a region left of the central region is defined as a left region, and a region right of the central region is defined as a right region, in a front view, a proportion of the plurality of unit regions in the central region is greater than a proportion of the plurality of unit regions in each of the left region and the right region.

Accordingly, in addition to inhibiting glare by ensuring that light is scattered around the top and bottom of the cutoff line in the center region of the field of view, an appropriate amount of light scattering can be maintained and sufficient illuminance can be ensured in the left and right regions of the field of view.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Figure 1:
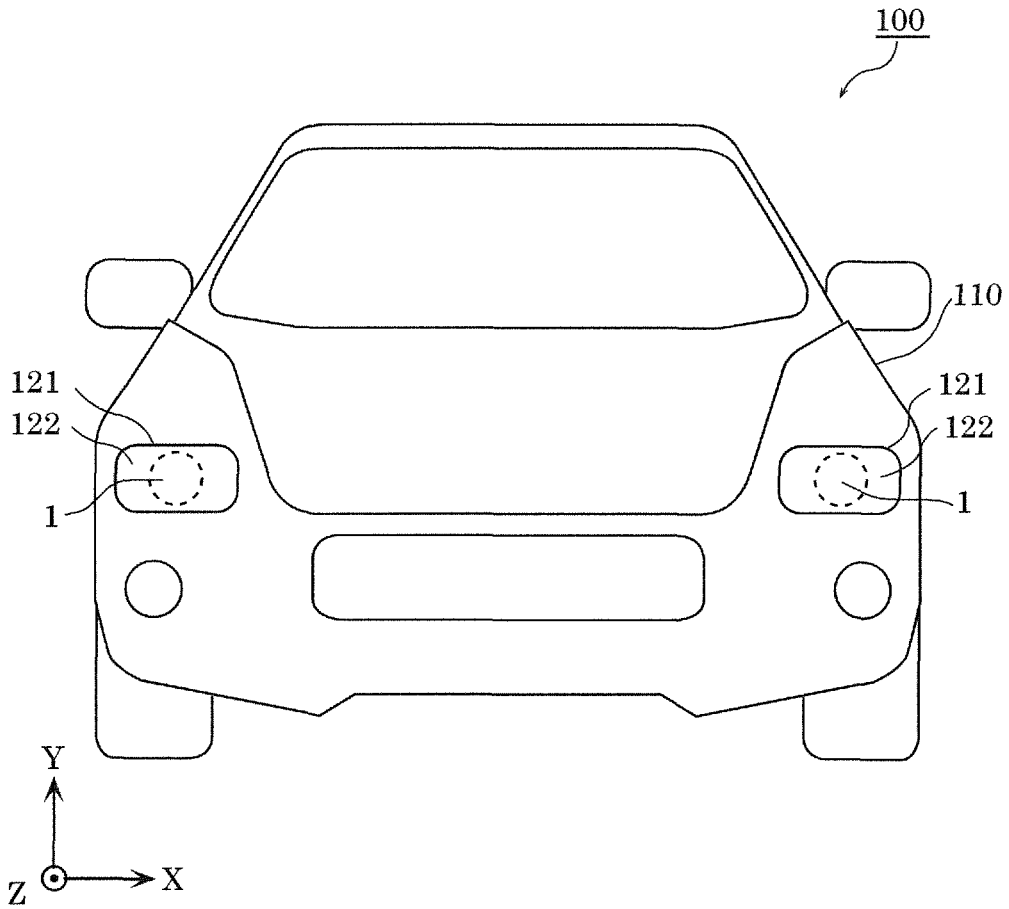
FIG. 1 is a front view of an automobile including a lighting apparatus according to an embodiment.

The following describes an embodiment of the present disclosure with reference to the drawings. Note that the embodiment described below shows a specific example of the present disclosure. The numerical values, shapes, materials, elements, the arrangement and connection of the elements, etc., indicated in the following embodiment are mere examples, and therefore do not intend to limit the inventive concept. Therefore, among the elements in the following embodiment, those not recited in any of the independent claims defining the most generic part of the inventive concept are described as optional elements.

Note that the drawings are represented schematically and are not necessarily precise illustrations. Additionally, like reference signs indicate like elements in the drawings, and overlapping descriptions thereof are omitted or simplified.

As described herein, "front" and "forward" refer to the direction in which light is emitted from the lighting apparatus (i.e., the light emitting direction) and the light-extraction direction in which light is extracted (i.e., the lighting direction), and "back" and "rearward" refer to the direction opposite the direction to which "front" and "forward" refer. Moreover, "front" and "forward" refer to the direction of travel when the automobile moves forward, "right" and "left" are from the perspective of the driver of the automobile when facing forward, "up" refers to the direction toward the ceiling of the automobile, and "down" and "downward" refer to the direction opposite the direction to which "up" refers.

The Z axis corresponds to the front and back directions, the Y axis corresponds to the up and down (vertical) directions, and the X axis corresponds to the left and right (horizontal, lateral) directions. In other words, in the following embodiment, "forward," which is the direction in which light is emitted from the headlamp, corresponds to the positive direction along the Z axis.

Embodiment (Automobile)

First, automobile 100 according to an embodiment will be described with reference to FIG. 1. FIG. 1 is a front view of automobile 100 according to the embodiment.

Automobile 100 according to this embodiment is one example of a vehicle, such as a four-wheeled automobile. Automobile 100 is, for example, an automobile propelled by a gasoline engine, an automobile propelled by an electric motor, or a hybrid automobile.

As illustrated in FIG. 1, automobile 100 includes lighting apparatus 1 and vehicle body 110 on which lighting apparatus 1 is installed as a headlamp. Vehicle body 110 includes two lighting apparatuses 1, one on each of the left and right sides of the front of vehicle body 110.

Housing 121 for housing lighting apparatus 1 and front cover 122 disposed in front of housing 121 are provided on vehicle body 110.

Housing 121 is, for example, a metal housing, and includes an opening through which light from lighting apparatus 1 is emitted. Front cover 122 is a light-transmissive headlamp cover and is disposed at the opening of housing 121. Housing 121 and front cover 122 are sealed together to keep water or dust, for example, from entering housing 121. Note that one housing 121 and one front cover 122 are disposed on each of the left and right sides of the front of vehicle body 110.

Lighting apparatus 1 is a lamp that emits light forward. Lighting apparatus 1 is disposed behind front cover 122 and attached to housing 121. Light emitted by lighting apparatus 1 passes through front cover 122 and travels forward from the front of automobile 100.

(Lighting Apparatus)

Figure 2:
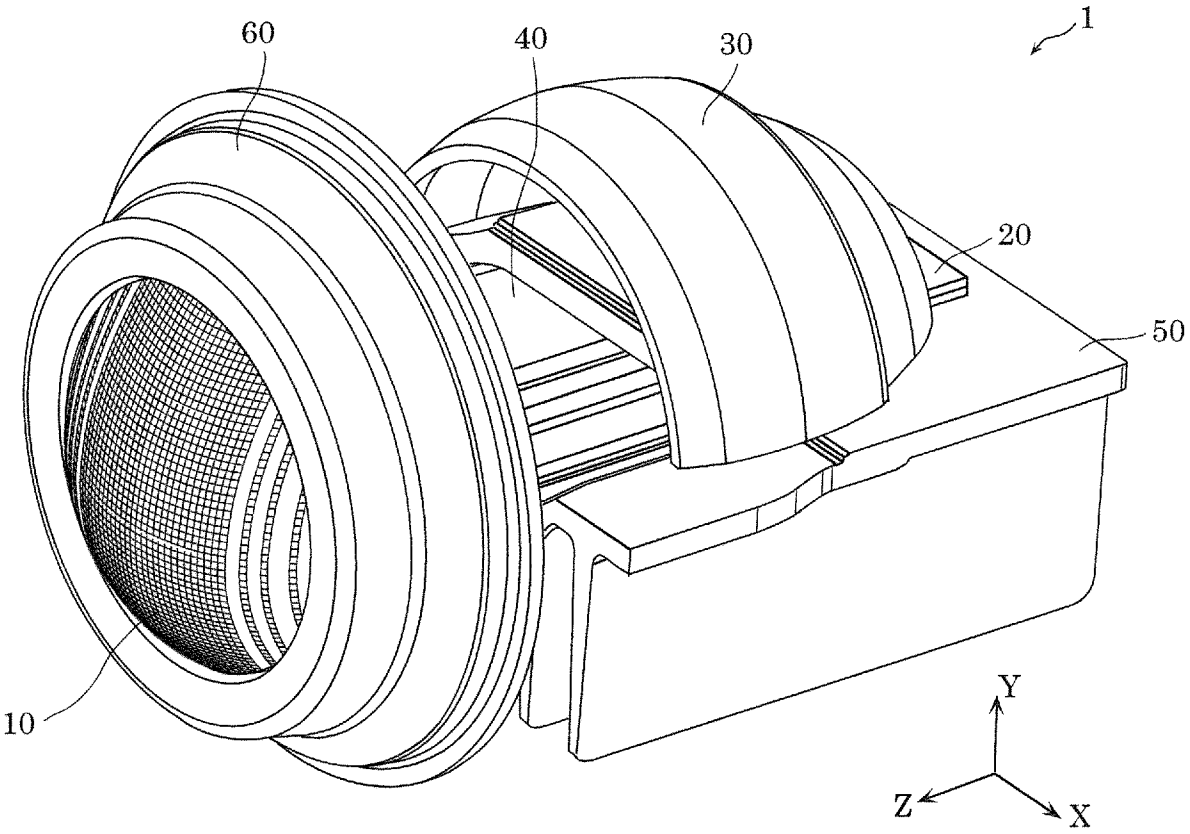
FIG. 2 is a perspective view of the lighting apparatus according to the embodiment.
Figure 3:
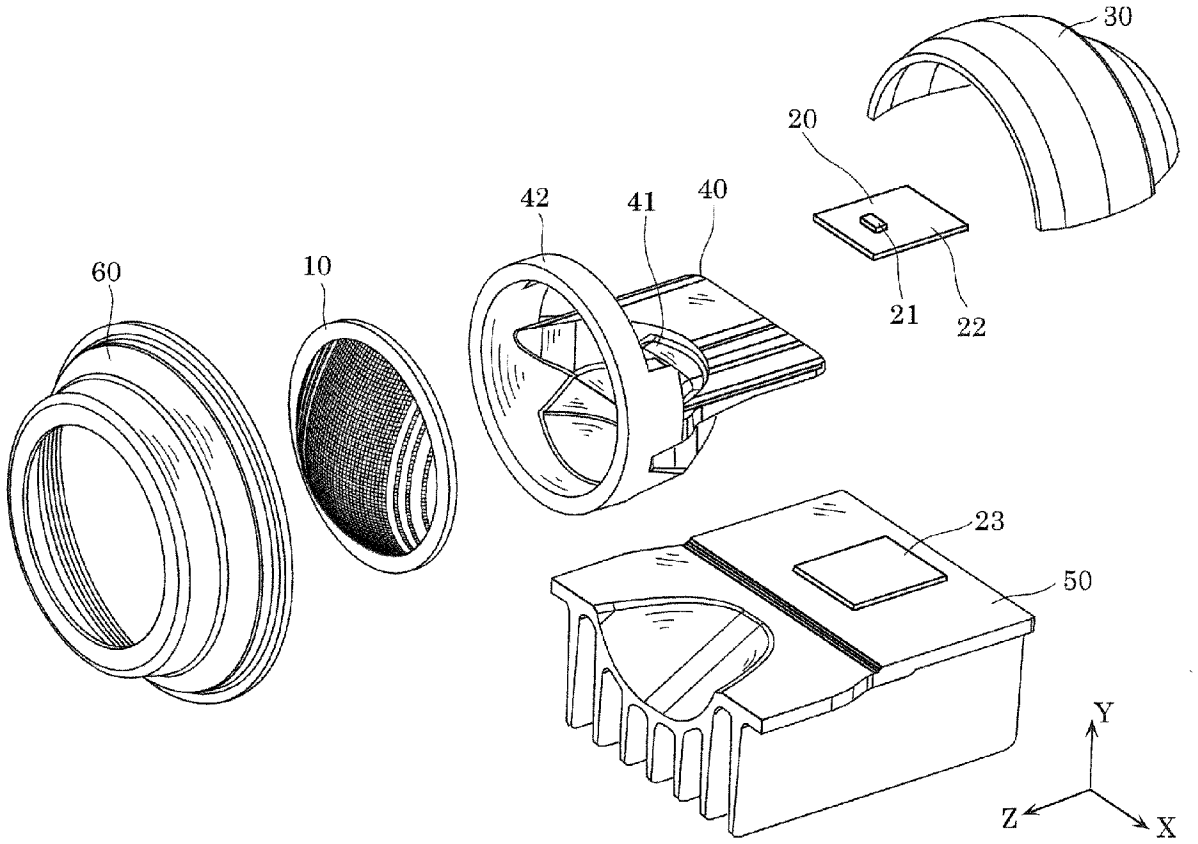
FIG. 3 is an exploded perspective view of the lighting apparatus according to the embodiment.
Figure 4:
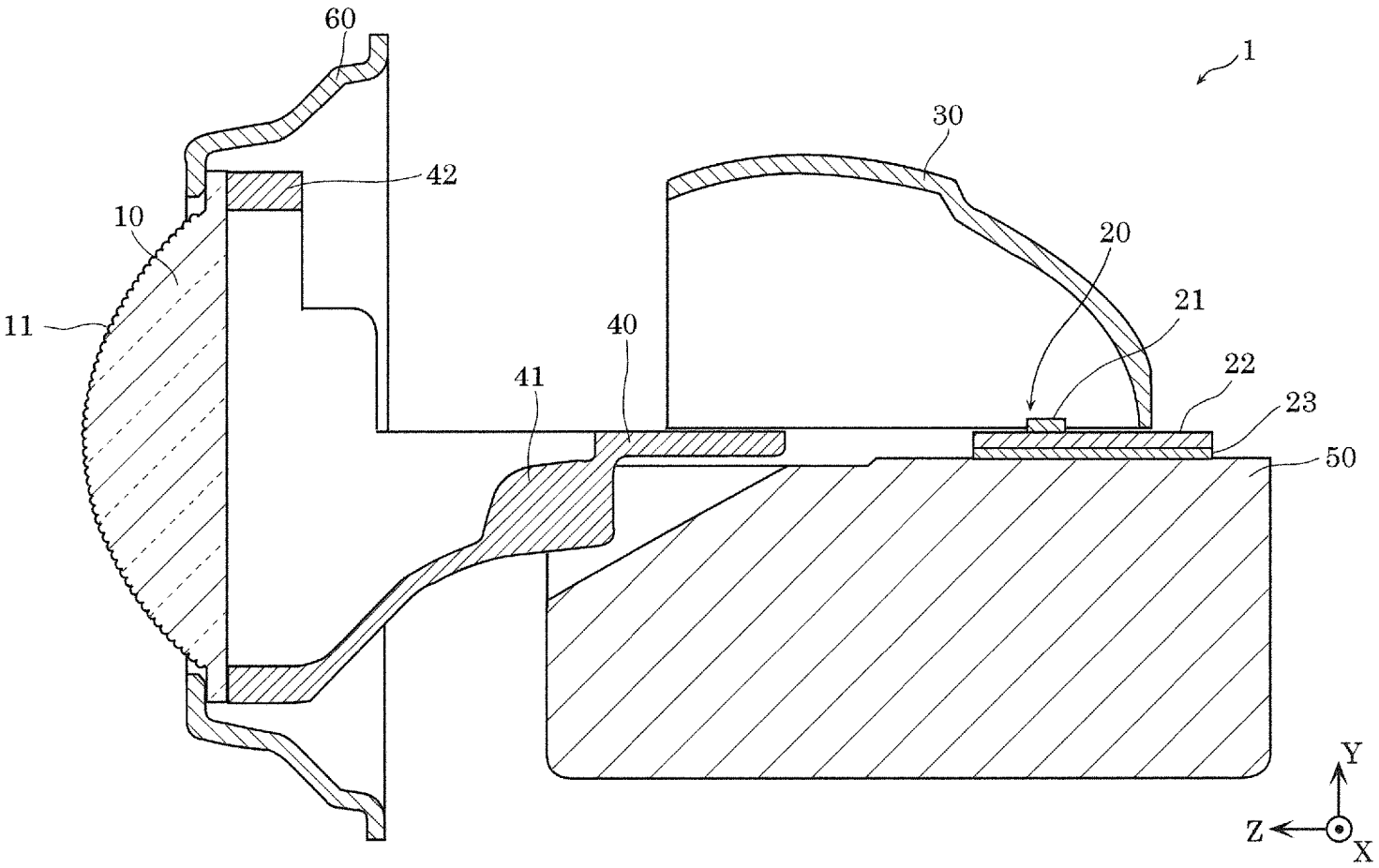
FIG. 4 is a cross-section view of a lighting apparatus according to the embodiment.

Next, lighting apparatus 1 according to this embodiment will be described with reference to FIG. 2 through FIG. 4. FIG. 2 is a perspective view of lighting apparatus 1 according to an embodiment. FIG. 3 is an exploded perspective view of lighting apparatus 1. FIG. 4 is a cross-section view of lighting apparatus 1 taken in the YZ plane.

As illustrated in FIG. 2 through FIG. 4, lighting apparatus 1 includes projection lens 10, light source 20, reflector 30, and shield 40. In this embodiment, lighting apparatus 1 further includes base 50 and frame 60. Lighting apparatus 1 emits light having a predetermined distribution pattern for illuminating, for example, a region in front of automobile 100.

Hereinafter, each element of lighting apparatus 1 will be described in detail.

(Projection Lens)

As illustrated in FIG. 2 through FIG. 4, projection lens 10 is located in front of light source 20 and reflector 30. Projection lens 10 is sandwiched and fixed in place between frame 60 and shield 40.

Projection lens 10 transmits light from light source 20. More specifically, projection lens 10 transmits light that has been emitted by light source 20 and reflected by reflector 30. In this example, projection lens 10 may refract the light it transmits to control the distribution of the light.

Projection lens 10 is made of a light-transmissive material. For example, projection lens 10 is made of a transparent resin, such as acrylic (PMMA), polycarbonate (PC), or cyclic olefin resin. Note that projection lens 10 is not limited to resin; projection lens 10 may be made of a different light-transmissive material, such as glass.

The front surface of projection lens 10 is curved so as to protrude as a whole. For example, as a whole, the front surface of projection lens 10 may be substantially spherical. In contrast, the rear surface of projection lens 10 is flat.

Figure 5:
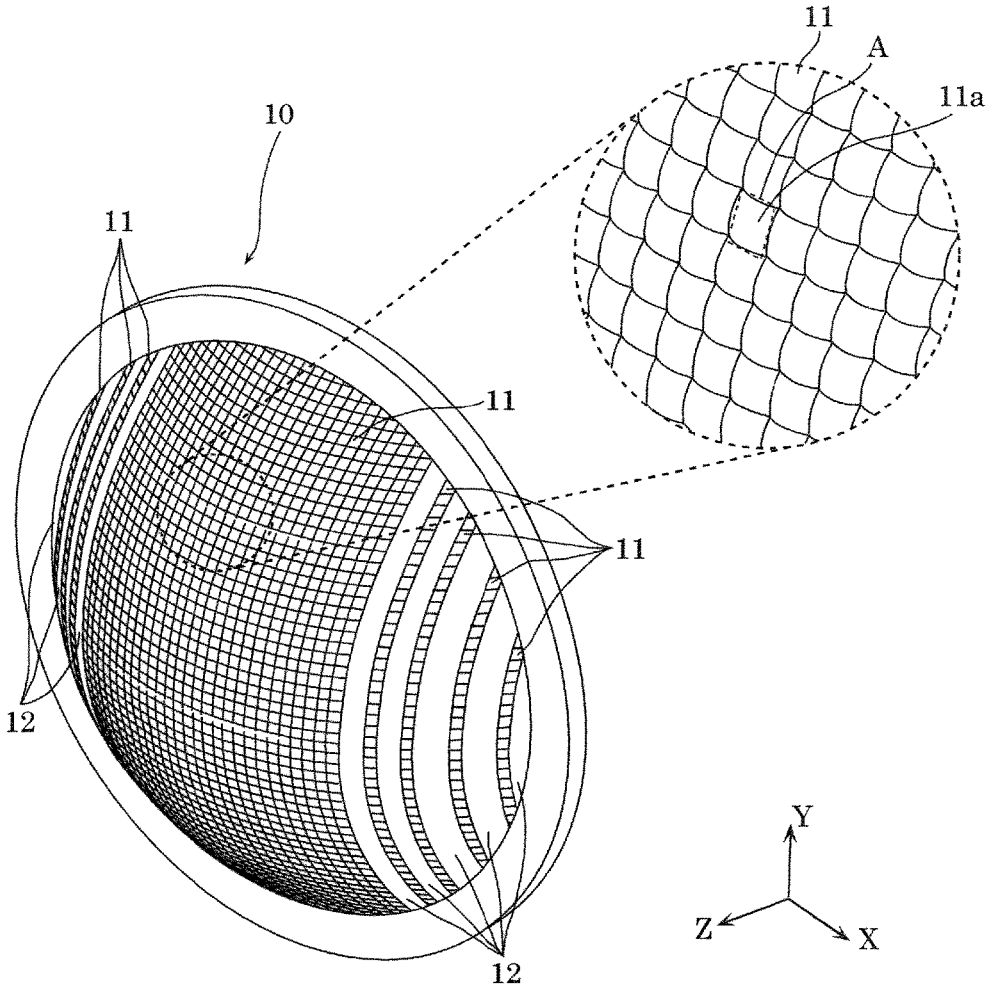
FIG. 5 is a perspective view of a projection lens included in the lighting apparatus according to the embodiment.
Figure 6:
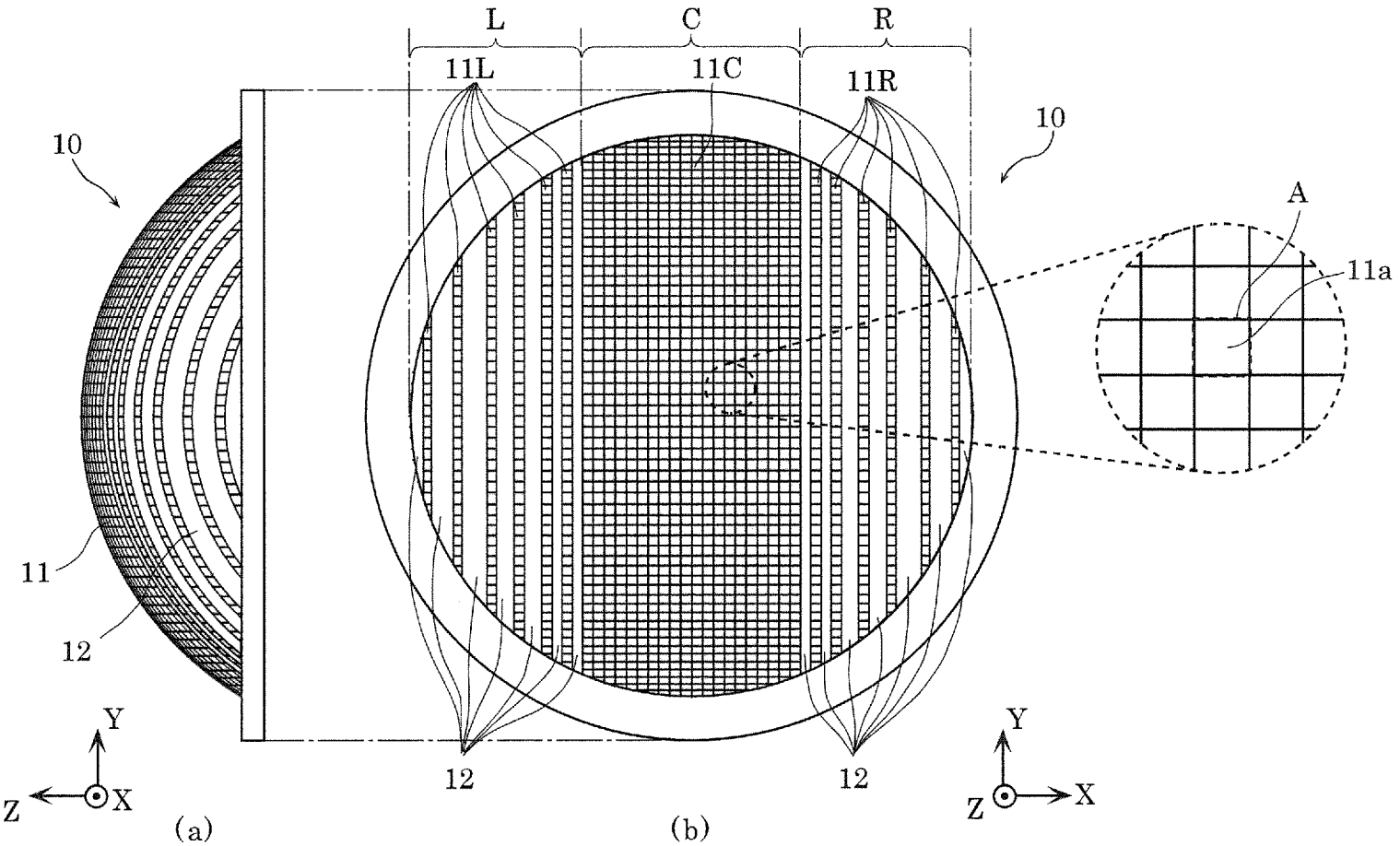
In FIG. 6, (a) is a side view and (b) is a front view of the projection lens included in the lighting apparatus according to the embodiment.

Next, the detailed structure of projection lens 10 according to this embodiment will be described with reference to FIG. 5 and FIG. 6. FIG. 5 is a perspective view of projection lens 10 included in lighting apparatus 1 according to this embodiment. In FIG. 6, (a) is a side view of projection lens 10, and (b) is a front view of projection lens 10.

As illustrated in FIG. 5 and FIG. 6, textured sections 11 demarcated by a plurality of virtual lines that intersect one another in a front view are formed on a surface of projection lens 10. More specifically, textured sections 11 demarcated by a plurality of unit regions A are formed on a surface of projection lens 10. Textured sections 11 are formed on the surface of projection lens 10 through which light exits projection lens 10 (i.e., the front surface). In other words, textured sections 11 are formed on the spherical front surface of projection lens 10.

Forming textured sections 11 on projection lens 10 gives projection lens 10 a light diffusing function. In other words, forming textured sections 11 on projection lens 10 makes it possible to scatter (diffuse) light passing through textured sections 11.

Moreover, unit region A is a minimum unit by which textured sections 11 are demarcated. Each unit region A has the same polygon shape in a front view of projection lens 10. More specifically, each unit region A has the same square shape in a front view of projection lens 10. Note that the shape of each unit region A may be a polygon when viewed along a normal of projection lens 10.

Textured sections 11 are configured of a plurality of protrusions 11*a*. Each protrusion 11*a* has the same shape. As illustrated in FIG. 5, each protrusion 11*a* has a convex surface with a predetermined curvature, such as the surface of dome or hemisphere, whose sides have been cut away to produce four edges that give each protrusion 11*a* a square plan view shape. The sides of two adjacent protrusions 11*a* are in contact with each other.

In this embodiment, one protrusion 11*a* is formed per unit region A. In other words, unit regions A and protrusions 11*a* are in one-to-one correspondence, and in this embodiment, in a front view, the outline of one protrusion 11*a* matches the outline of one unit region A. Note that it is acceptable if the outline of one protrusion 11*a* does not match the outline of the corresponding unit region A; protrusion 11*a* may be within the corresponding unit region A. Thus, adjacent protrusions 11*a* do not necessarily contact each other.

Moreover, as illustrated in (b) in FIG. 6, when a region in the center of projection lens 10 is defined as central region C, a region to the left of central region C is defined as left region (left side region) L, and a region to the right of central region C is defined as right region (right side region) R, only textured section 11 is present in central region C, and both textured sections 11 and flat sections 12 are present in left region L and right region R.

Textured sub-section 11C in central region C is configured of unit regions A arranged in a tiling layout. In other words, textured sub-section 11C in central region C is lined with protrusions 11*a* included in respective unit regions A, and in this embodiment, protrusions 11*a* are lined such that textured sub-section 11C extends vertically and has a uniform lateral width.

Textured sub-sections 11L in left region L and textured sub-sections 11R in right region R are also configured of unit regions A arranged in a tiling layout. In this embodiment, textured sub-sections 11L in left region L and textured sub-sections 11R in right region R are formed in a plurality of columns. In left region L and right region R, each column of textured sub-sections 11L and 11R is formed of a plurality of unit regions A arranged in a vertical direction in a front view. In other words, each column of textured sub-sections 11L and 11R is formed of protrusions 11*a* aligned in a vertical direction in a front view. Note that in this embodiment, textured sub-sections 11L in left region L and textured sub-sections 11R in right region R are formed in, but not limited to, six columns each.

Moreover, flat sections 12 are formed extending vertically in a front view between adjacent columns of textured sub-sections 11L in left region L and between adjacent columns of textured sub-sections 11R in right region R. Note that in this embodiment, flat sections 12 are formed in, but not limited to, 7 columns in each of left region L and right region R.

The surface of each flat section 12 is an untextured, curved surface. Flat sections 12 formed between columns of textured sub-sections 11L and textured sub-sections 11R have a shape that allows for unit regions A to be arranged in a tiling layout. In other words, flat sections 12 have a shape that would accommodate unit regions A (with protrusions 11*a*) if flat sections 12 were to be lined with unit regions A.

Further, in a front view of projection lens 10, the proportion of unit regions A in central region C is greater than the proportion of unit regions A in each of left region L and right region R. In other words, in a front view, the density of protrusions 11*a* in central region C is greater than the density of protrusions 11*a* in left region L and the density of protrusions 11*a* in right region R. Stated differently, in a front view of projection lens 10, the proportion (density) of unit regions A in each of left region L and right region R is less than the proportion (density) of unit regions A in central region C.

Further, in left region L and right region R, the proportion of unit regions A gradually decreases in an outward direction. More specifically, in left region L and right region R, the proportion of unit regions A gradually decreases in both directions along the X axis (right and left directions) from the center of projection lens 10. In other words, in left region L and right region R, the density of protrusions Ha gradually decreases in an outward direction along the X axis. More specifically, the size of the gaps between columns of textured sections 11 increases in an outward direction.

Projection lens 10 configured in this manner can be manufactured by, for example, resin forming using a resin material.

Note that in this embodiment, projection lens 10 has bilateral symmetry whereby the shape of the surface of projection lens 10 is the same in left region L and right region R, but the shape of the surface of projection lens 10 may be different in left region L and right region R. In this way, it is possible to adjust the appearance of the distribution of light on the right and left sides by differentiating the shapes of the surfaces of left region L and right region R (i.e., by differentiating the shapes of the surfaces of the oncoming traffic side region and the driving side region of projection lens 10). For example, when a wider distribution of light on the right side of the automobile is desired, in the left side lighting apparatus 1 from the perspective of the driver, protrusions 11*a* in left region L from the perspective of the driver may be formed to be less dense than protrusions 11*a* in right region R from the perspective of the driver. In other words, from the perspective of the driver, the proportion of unit regions A in the entire left region L may be less than the proportion of unit regions A in the entire right region R.

(Light Source)

Light source 20 is a white-light light source that emits white light. Light source 20 is, for example, a B—Y type white-light LED light source that emits white light using a blue-light LED that emits blue light and yellow phosphor. Note that light source 20 may be a white-light LED light source that emits white light using a plurality of LED chips that emit blue, red, and green light.

As illustrated in FIG. 3 and FIG. 4, light source 20 is a light source module that includes light emitter 21 and substrate 22 on which light emitter 21 is mounted. In this embodiment, light source 20 has an surface mount device (SMD) structure. In other words, light emitter 21 is, for example, an SMD LED device configured of an LED chip (bare chip) mounted in a resin container and sealed with a sealant. In this case, the sealant may be a phosphor-containing resin that contains a wavelength converter such as phosphor.

Note that light source 20 may have a chip on board (COB) structure. With this structure, light emitter 21 is an LED chip (bare chip) itself, and the LED chip directly mounted on substrate 22. In this case, the LED chip mounted on substrate 22 is sealed by a sealant such as a phosphor-containing resin.

Examples of substrate 22 include a ceramic substrate made of a sintered ceramic material such as alumina, a resin substrate made of an electrically insulating resin, and a metal based substrate configured of a metal base covered with an electrical insulator.

As illustrated in FIG. 4, light source 20 is disposed behind projection lens 10. Light source 20 is fixed to base 50. More specifically, substrate 22 is placed on and fixed to a predetermined placement surface of base 50 with heat dissipating material 23 therebetween. This makes it possible to dissipate heat generated by light source 20 to base 50. Heat dissipating material 23 is, for example, a highly thermally conductive liquid heat-dissipating silicon or a heat dissipating sheet. Heat dissipating material 23 is made of an electrically insulating material, for example.

Moreover, in this embodiment, substrate 22 is arranged laying flat (i.e., horizontally) so that light source 20 emits light in an upward direction. This makes it possible for light source 20 (light emitter 21) to emit light toward reflector 30.

In this embodiment, light source 20 is a low beam light source that emits light that forms a low beam (passing beam). The low beam light source is turned on when an area forward and downward of automobile 100 (more specifically, when the road surface) is to be illuminated. Light emitted by low beam light source is projected from lighting apparatus 1 as illumination light having a predetermined distribution pattern in which a cutoff line is formed as a result of light from the low beam light source reflecting off reflector 30 and partially being blocked by shield 40.

Although not illustrated in the drawings, note that a high beam light source, which emits light that forms a high beam (driving beam), may also be disposed on base 50 in addition to the low beam light source (light source 20). The high beam light source is turned on when a region far ahead of automobile 100 is to be illuminated. The high beam light source is also a white-light light source, and has the same configuration as light source 20. Light from high beam light source may also pass through projection lens 10.

(Reflector)

Reflector 30 illustrated in FIG. 2 through FIG. 4 is a reflector that reflects light from light source 20 toward projection lens 10. Reflector 30 is disposed in a path of light from light source 20. Reflector 30 has a reflective inner surface which faces light source 20.

Reflector 30 is, for example, formed by resin molding using a heat resistant resin, and a reflective film is formed on the surface. For example, polycarbonate can be used as the high resistant resin. Alternatively, instead of a heat resistant resin, fiber reinforced plastic (FRP) or a bulk molding compound (BMC) may be used. The reflective film is, for example, a metal deposition film such as an aluminum deposition film. The reflective film forms the reflective surface of reflector 30, and specularly reflects light from light source 20.

(Shield)

Shield 40 illustrated in FIG. 2 through FIG. 4 is a shield that blocks a portion of light that has been emitted by light source 20 and reflected by reflector 30 to form a cutoff line in the distribution pattern of the light. Shield 40 is disposed between projection lens 10 and light source 20, and is attached to base 50. Shield 40 is, for example, formed using a heat resistant resin or fiber reinforced plastic, similar to reflector 30.

As illustrated in FIG. 3 and FIG. 4, shield 40 includes shielding section 41 for blocking a portion of the light reflected by reflector 30 and forming a cutoff line, and lens support section 42 that supports projection lens 10.

Shielding section 41 is a cutoff line forming section that forms a cutoff line (boundary between light and dark areas) in the light distribution pattern of lighting apparatus 1 by blocking a portion of light that has been emitted by light source 20 and reflected by reflector 30. Shielding section 41 passes through a rear focal point of projection lens 10.

Lens support section 42 supports projection lens 10 by sandwiching projection lens 10 with frame 60. Lens support section 42 is formed into a substantially circular ring shape that corresponds to the outer shape of projection lens 10. Shield 40 and projection lens 10 can be appropriately positioned by abutting lens support section 42 to projection lens 10.

(Base)

As illustrated in FIG. 2 through FIG. 4, base 50 is a support component that supports light source 20 and also a heat dissipating component for dissipating heat generated by light source 20 out (to the atmosphere). As such, base 50 includes, for example, a material with a high rate of heat transfer, such as metal. Base 50 is, for example, an aluminum die case base including composite aluminum. Base 50 includes a plurality of heat dissipating fins.

Light source 20 is fixed to base 50. More specifically, light source 20 is placed and fixed to the placement surface, which is the top surface, of base 50. Although not illustrated in the drawings, a high beam light source is also fixed to base 50 in addition to light source 20, which is the low beam light source.

(Frame)

As illustrated in FIG. 2 through FIG. 4, frame 60 sandwiches projection lens 10 with shield 40 to support projection lens 10. Frame 60 has the shape of a substantially circular ring. The outer perimeter of frame 60 approximately matches the outer shape of lighting apparatus 1 in a front view. For example, frame 60 is made of, but is not limited to, a resin material; frame 60 may be made of a metal material.

Advantageous Effects, Etc

With lighting apparatus 1 according to this embodiment, as illustrated in (b) in FIG. 6, textured sections 11 demarcated by unit regions A are formed on a surface of projection lens 10, and in a front view of projection lens 10, the proportion of unit regions A in central region C is greater than the proportion of unit regions A in each of left region L and right region R.

With this, luminance can be increased in left region L and right region R of projection lens 10 by making the scattering effect of left region L and right region R weaker than the scattering effect of central region C. As a result, light passing through central region C of projection lens 10 can be sufficiently scattered and light passing through left region L and right region R of projection lens 10 can be appropriately scattered to achieve greater luminance in left region L and right region R than central region C. Thus, in addition to inhibiting glare by ensuring that light is scattered around the top and bottom of the cutoff line in the center region of the field of view, an appropriate amount of light scattering can be maintained and sufficient illuminance can be ensured in the left and right regions of the field of view. By ensuring sufficient luminance in the left and right regions of the field of view, the driver of the automobile can easily spot pedestrians.

Moreover, in this embodiment, in a front view, each unit region A has a regular polygon shape or a vertically elongated polygon shape.

This makes it easier to reduce glare around the top and bottom of the cutoff line in the center region of the field of view and maintain an appropriate amount of light scattering and ensure sufficient illuminance in the left and right regions of the field of view.

Moreover, in this embodiment, shield 40 includes shielding section 41 that blocks the portion of the light reflected by reflector 30 to form the cutoff line, and shielding section 41 passes through a rear focal point of projection lens 10.

This makes it possible to easily form a cutoff line in distribution pattern of light from lighting apparatus 1.

Moreover, in this embodiment, in left region L and right region R, textured sections 11 (textured sub-sections 11L, 11R) are formed in columns, each of the columns of textured sections 11 (textured sub-sections 11L, 11R) is formed of a plurality of unit regions A arranged in a vertical direction in a front view, and flat sections 12 are formed extending vertically in a front view between adjacent columns of textured sections 11 (textured sub-sections 11L, 11R).

In this way, by forming flat sections 12 in left region L and right region R, the proportion of unit regions A in left region L and right region R can be easily reduced. Accordingly, the proportion of unit regions A in central region C can be made be greater than the proportion of unit regions A in left region L and the proportion of unit regions A in right region R.

In this case, flat sections 12 may have a shape that allows for a plurality of unit regions A to be arranged in a tiling layout.

With this, in left region L and right region R, unit regions A can be formed in either textured sections 11 (textured sub-sections 11L, 11R) or flat sections 12. As such, the scattering effect of left region L and right region R of projection lens 10 can be appropriately and easily adjusted, making it possible to easily maintain an appropriate amount of light scattering and ensure sufficient illuminance in the left and right regions of the field of view.

Moreover, in this embodiment, in central region C, textured section 11 (textured sub-section 11C) includes a plurality of unit regions A arranged in a tiling layout.

This makes it possible to sufficiently scatter light that passes through central region C of projection lens 10.

Moreover, in this embodiment, in left region L and right region R, the proportion of the plurality of unit regions A gradually decreases in an outward direction.

This makes it possible make changes in the behavior of light between different positions in left region L and right region R of projection lens 10 less drastic. As a result, change in luminance in left region L and right region R can be less drastic by decreasing the luminance in a gradation in an outward direction. Thus, a light distribution pattern which does not appear abnormal to the driver can be achieved.

Moreover, in this embodiment, the surface of projection lens 10 on which textured sections 11 are formed is a surface through which light exits projection lens 11.

With this, a scattering effect can be applied to light emitted from projection lens 10, making it possible to easily achieve a desired distribution pattern of light.

(Variation)

Although the lighting apparatus and automobile according to the present disclosure have hereinbefore been described based on embodiments, the present disclosure is not limited to these embodiments.

Figure 7:
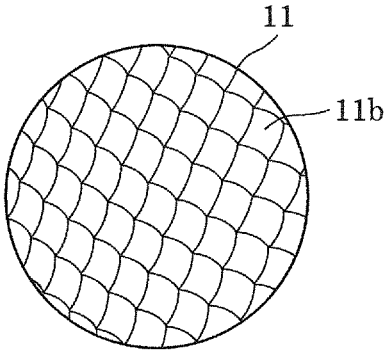
FIG. 7 is an enlarged view of relevant parts of a projection lens according to Variation 1.
Figure 8:
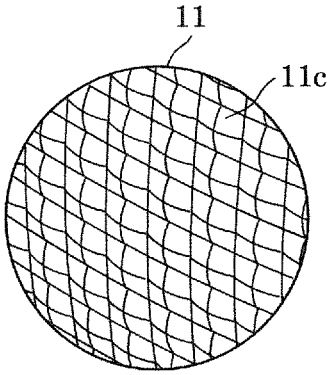
FIG. 8 is an enlarged view of relevant parts of a projection lens according to Variation 2.

For example, in the above embodiment, the shape of textured sections 11 in each unit region A of projection lens 10 is a protrusion as exemplified by protrusion 11*a*, but any shape that scatters light may be used. More specifically, the shape of textured sections 11 in each unit region A may be a depression as exemplified by depression 11*b* having a concave surface with a predetermined curvature, as illustrated in FIG. 7, or a protrusion as exemplified by protrusion 11*c* having a combination of concave and convex surfaces, as illustrated in FIG. 8.

Figure 9:
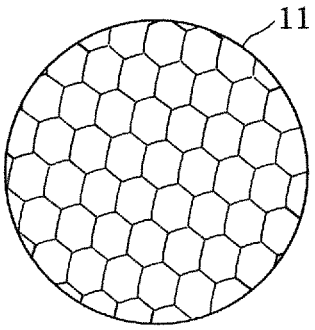
FIG. 9 is an enlarged view of relevant parts of a projection lens according to Variation 3.

Moreover, in the above embodiment, the shape of each unit region A in textured sections 11 is rectangular in a front view, but the shape is not limited to this example. For example, in a front view, each unit region A may have a regular polygon shape such as a regular pentagon shape, a regular hexagon shape, or a regular pentagon shape, and, alternatively, may have a vertically elongated polygon shape. Note that FIG. 9 illustrates an example of when each unit region A has a vertically elongated hexagon shape.

Moreover, in the above embodiment, the proportion of unit regions A in each of left region L and right region R of projection lens 10 is made to be less than the proportion of unit regions A in central region C by forming band-like flat sections 12 that extend vertically in left region L and right region R, but this example is not limiting. For example, the proportion of unit regions A in each of left region L and right region R of projection lens 10 may be made to be less than the proportion of unit regions A in central region C by forming flat sections 12 by arranging protrusions 11*a* in left region L and right region R in a checkerboard pattern, a checkerboard pattern with random alterations, or in a random pattern.

Moreover, in the above embodiment, textured sections 11 are formed on the surface of projection lens 10 through which light exits, but this example is not limiting. For example, textured sections 11 may be formed on the surface of projection lens 10 through which light enters projection lens 10 (i.e., the rear surface).

Moreover, in the above embodiment, automobile 100 includes two lighting apparatuses 1, but automobile 100 is not limited to this example. For example, automobile 100 may include two lighting apparatuses 1 on each of the right and left sides of vehicle body 110. Alternatively, automobile 100 may include three or more lighting apparatuses 1, and may include only one lighting apparatus 1.

Moreover, in the above embodiment, the light emitter is exemplified as an LED, but the light emitter may be a semiconductor device such as a semiconductor laser, an electroluminescent (EL) device such as an organic EL devices or non-organic EL device, or any other solid state light-emitting device.

Moreover, although the automobile is exemplified as a four-wheeled automobile in the above embodiment, the automobile may be another type of automobile such as a two-wheeled automobile (motorbike).

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus, comprising:

a projection lens;

a light source behind the projection lens;

a reflector that reflects light from the light source toward the projection lens; and a shield that blocks a portion of the light reflected by the reflector to form a cutoff line in a distribution pattern of the light, wherein a textured section demarcated by a plurality of unit regions is formed on a surface of the projection lens, and when a region in a center of the projection lens is defined as a central region, a region left of the central region is defined as a left region, and a region right of the central region is defined as a right region, wherein when the lighting apparatus is used in an automobile, right is relative to a forward direction of travel of the automobile and left is relative to the forward direction of travel of the automobile, in a front view, a proportion of the plurality of unit regions in the central region is greater than a proportion of the plurality of unit regions in each of the left region and the right region.

2. The lighting apparatus according to claim 1, wherein in the front view, each of the plurality of unit regions has either one of a regular polygon shape and a vertically elongated polygon shape.

3. The lighting apparatus according to claim 1, wherein the shield includes a shielding section that blocks the portion of the light reflected by the reflector to form the cutoff line, and the shielding section passes through a rear focal point of the projection lens.

4. The lighting apparatus according to claim 1, wherein in the left region and the right region, the textured section comprises textured sub-sections formed in columns, each of the columns of the textured sub-sections is formed of a plurality of the unit regions arranged in a vertical direction in the front view, and a flat section is formed extending vertically in the front view between adjacent columns among the columns of the textured sub-sections.

5. The lighting apparatus according to claim 4, wherein the flat section has a shape that allows for a plurality of the unit regions to be arranged in a tiling layout.

6. The lighting apparatus according to claim 1, wherein in the central region, the textured section includes a plurality of the unit regions arranged in a tiling layout.

7. The lighting apparatus according to claim 1, wherein in the left region and the right region, the proportion of the plurality of unit regions gradually decreases in an outward direction.

8. The lighting apparatus according to claim 1, wherein the surface of the projection lens on which the textured section is formed is a surface through which light exits the projection lens.

9. An automobile, comprising:

the lighting apparatus according to claim 1; and a vehicle body on which the lighting apparatus is installed as a headlamp.

10. A projection lens, comprising:

a light-transmissive lens substrate;

wherein a textured section demarcated by a plurality of unit regions is formed on a surface of the substrate, and when a region in a center of the projection lens is defined as a central region, a region left of the central region is defined as a left region, and a region right of the central region is defined as a right region, wherein when the projection lens is used in an automobile, right is relative to a forward direction of travel of the automobile and left is relative to the forward direction of travel of the automobile, in a front view, a proportion of the plurality of unit regions in the central region is greater than a proportion of the plurality of unit regions in each of the left region and the right region.

11. A lighting apparatus, comprising:

a projection lens;

a light source behind the projection lens;

a reflector that reflects light from the light source toward the projection lens; and a shield that blocks a portion of the light reflected by the reflector to form a cutoff line in a distribution pattern of the light, wherein a textured section demarcated by a plurality of unit regions is formed on a surface of the projection lens, when a region in a center of the projection lens is defined as a central region, a region left of the central region is defined as a left region, and a region right of the central region is defined as a right region, wherein the lighting apparatus is used in an automobile and right is relative to a forward direction of travel of the automobile and left is relative to the forward direction of travel of the automobile, at least some of the unit regions in the plurality of unit regions are provided in each of the central region, the left region, and the right region, and in a front view, a proportion of the plurality of unit regions in the central region is greater than a proportion of the plurality of unit regions in each of the left region and the right region.

* * * * *